United States Patent [19]

Meeker

[11] Patent Number: 5,014,684

[45] Date of Patent: May 14, 1991

[54] WALL SHIELD AND CHIMNEY SUPPORT

[76] Inventor: John G. Meeker, 24 Jamestown St., Sinclairville, N.Y. 14782-0568

[21] Appl. No.: 574,989

[22] Filed: Aug. 29, 1990

Related U.S. Application Data

[63] Continuation-in-part of Ser. No. 366,281, Jun. 13, 1989, Pat. No. 4,957,098, which is a continuation of Ser. No. 203,853, Jun. 7, 1988, abandoned.

[51] Int. Cl.[5] ..... F24B 1/188

[52] U.S. Cl. ..... 126/531; 126/67; 126/83

[58] Field of Search ..... 126/500, 509, 515, 77, 126/67, 82, 83, 531, 529, 523–526, 528, 312–316; 98/58, 60

[56] References Cited

U.S. PATENT DOCUMENTS

| | | | |
|---|---|---|---|
| 4,169,458 | 10/1979 | Shaw | 126/531 |
| 4,224,921 | 9/1980 | Petrescue | 126/531 |
| 4,266,526 | 5/1981 | Tolotti | 126/531 |
| 4,519,376 | 5/1985 | Schoeff et al. | 126/531 |
| 4,607,611 | 8/1986 | Rice et al. | 126/531 |
| 4,681,087 | 7/1987 | Meeker | 126/504 |
| 4,700,687 | 10/1987 | Bailey et al. | 126/500 |
| 4,957,098 | 9/1990 | Meeker | 126/531 |

*Primary Examiner*—James C. Yeung
*Attorney, Agent, or Firm*—Pennie & Edmonds

[57] ABSTRACT

An improved wall shield and chimney support (WSCS) unit adapted to fit flush within the wall of a dwelling is disclosed. The WSCS unit includes ducts for ducting cooling air entirely around the inner wall of the unit and especially around the front lateral corners and top. The airflows are separated into outer and inner flows with the inner flow insulating the outer flow from combustion heat. The outer flow is then directed to the front of the unit top whereby a hot combustion unit can be brought into close juxtaposition with the WSCS unit without substantial danger of fire. Plural ducts are provided for cooling the rear wall of the unit, having inlets at the bottom rear of the fireplace unit, extending upwardly along the rear wall of the unit, and forwardly around the chimney, further cooling this area. The cooling of the chimney area is also increased by focusing the cooling air with baffles as it passes by the chimney. The baffles and vertical wall of a transverse duct at the top front of the unit allow the unit to support a conventional chimney without further support structure.

18 Claims, 5 Drawing Sheets

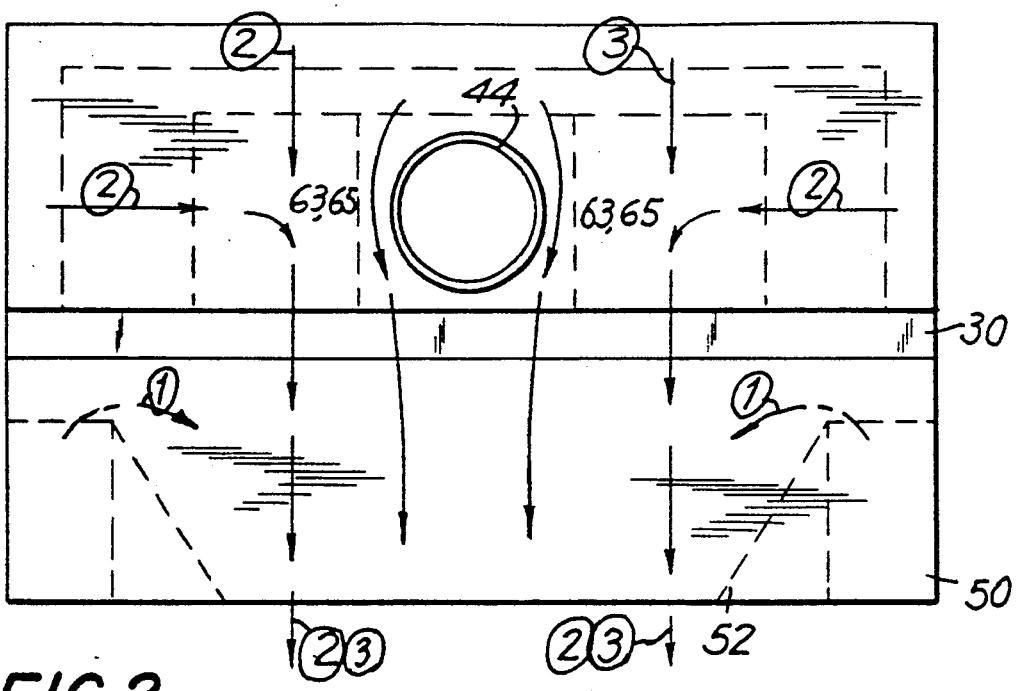
FIG. 2
FIG. 3
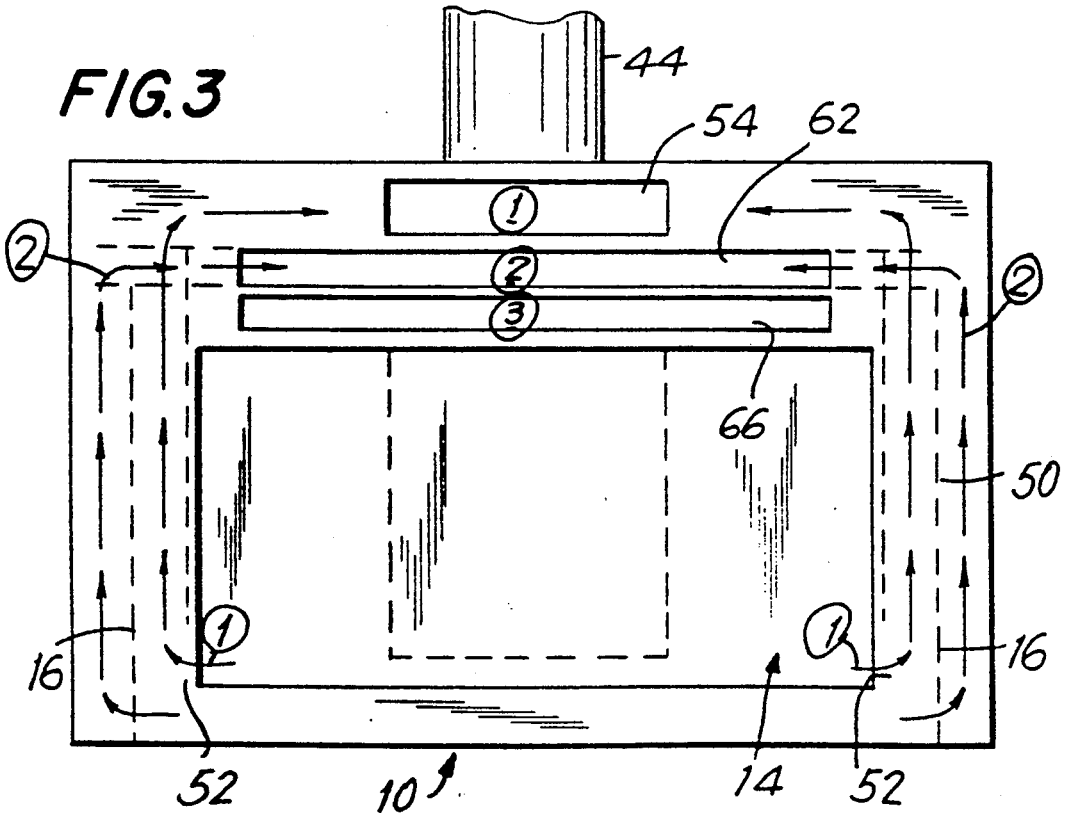

WALL SHIELD AND CHIMNEY SUPPORT

RELATED APPLICATIONS

This application is a continuation in part of application Ser. No. 07/366,281 filed June 13, 1989, U.S. Pat. No. 4,957,098 which is a continuation of application Ser. No. 07/203,853, filed June 7, 1988, abandoned.

FIELD OF THE INVENTION

This invention relates to an improved construction for a wall shield and chimney support, which in combination with an energy efficient combustion unit comprises a prefabricated zero clearance fireplace.

BACKGROUND OF THE INVENTION

In recent years the rise of petroleum and other fossil fuel energy costs has led to a resurgence of interest in burning wood as a primary source of heat for residential use. However, progress remains to be made in the area of prefabricated fireplaces for installation in homes. Specifically, with prior prefabricated fireplaces the combustible materials such as wood and drywall commonly used in home construction could not be brought into direct contact with the fireplace, particularly around the face of the fireplace. Prior zero clearance designs require excessive house air to perform this cooling function.

SUMMARY OF THE INVENTION

Accordingly, it is an object of the invention to provide a wall shield and chimney support for residential use which addresses and solves these problems exhibited by the fireplaces in the prior art. Specifically, it is an object of the invention to provide a means for installing a combustion unit or fireplace type structure substantially flush with a surrounding wall, and in which the combustible materials of the wall can be brought directly up to the edge of the invention so that no noncombustible material need be interposed therebetween. It is a further object of the invention to provide an enclosure for a combustion unit, the structure of which has sufficient structural integrity to support a relatively heavy chimney thereon.

These and other objects of the invention which will appear to those of skill in the art as the discussion below proceeds are fulfilled by the present invention which comprises a wall shield and chimney support (WSCS) unit. The WSCS unit comprises a metal box into which a combustion unit can be inserted, such as the highly efficient wood kiln device shown in Applicant's prior U.S. Pat. No. 4,681,087. The WSCS unit includes means for ducting cooling air around the interior surface of the box and the exterior of the combustion unit thus preventing the wall from reaching the combustion temperatures of common house construction materials. Accordingly, these construction materials can be brought into direct contact with the outer surface of the WSCS unit. The top of the WSCS unit further comprises a support beam which is sufficiently strong to support the weight of a chimney thereon, further simplifying construction of a house using the WSCS unit.

More specifically, the WSCS unit comprises means for ducting cooling air around an opening in the front of the WSCS which receives the combustion unit. This ducting comprises inlets at the lower corners of the opening, which then run vertically upwardly and then inwardly across the top front of the WSCS unit to cool it, exiting out the front of the unit. The cooling air is separated into two separate airflows in the vertical ducting so that one airflow is interposed between the combustion unit and the second airflow. The second airflow thus remains cool and provides very effective cooling when circulated around the hottest parts of the unit top. Similar ducting is provided in the rear wall, with inlets at the bottom center of the rear wall, to direct air around the chimney member in order to cool it. Additional ducting is provided to thermally shield the sides and the back wall of the unit, via further air ducts also exiting through its front. The result is that the outer surface of the WSCS unit is kept cool by the internal convection of air. The duct structure in the top of the unit is also formed to provide stiffness for supporting a chimney pipe in addition to creating the plural airflow paths.

BRIEF DESCRIPTION OF THE DRAWINGS

The invention will be better understood if reference is made to the accompanying drawings, in which:

FIG. 2 shows a top view of the unit according to FIG. 1, showing airflow therein;

FIG. 3 shows a front elevational view of the unit according to FIG. 1, also showing airflow therein;

DETAILED DESCRIPTION OF THE INVENTION

As described above, a principal object of the invention is to provide a wall shield and chimney support (WSCS) unit which can be installed with conventional flammable building materials contacting its front surfaces so that the front of the WSCS unit can be flush to, and in contact with, the materials of the surrounding wall. A second object of the invention is to provide a prefabricated WSCS unit that is sufficiently strong to bear the weight of a chimney, so that no separate structural provision need be made therefor. The WSCS unit 10 of the invention achieves these objects.

Figure 4:
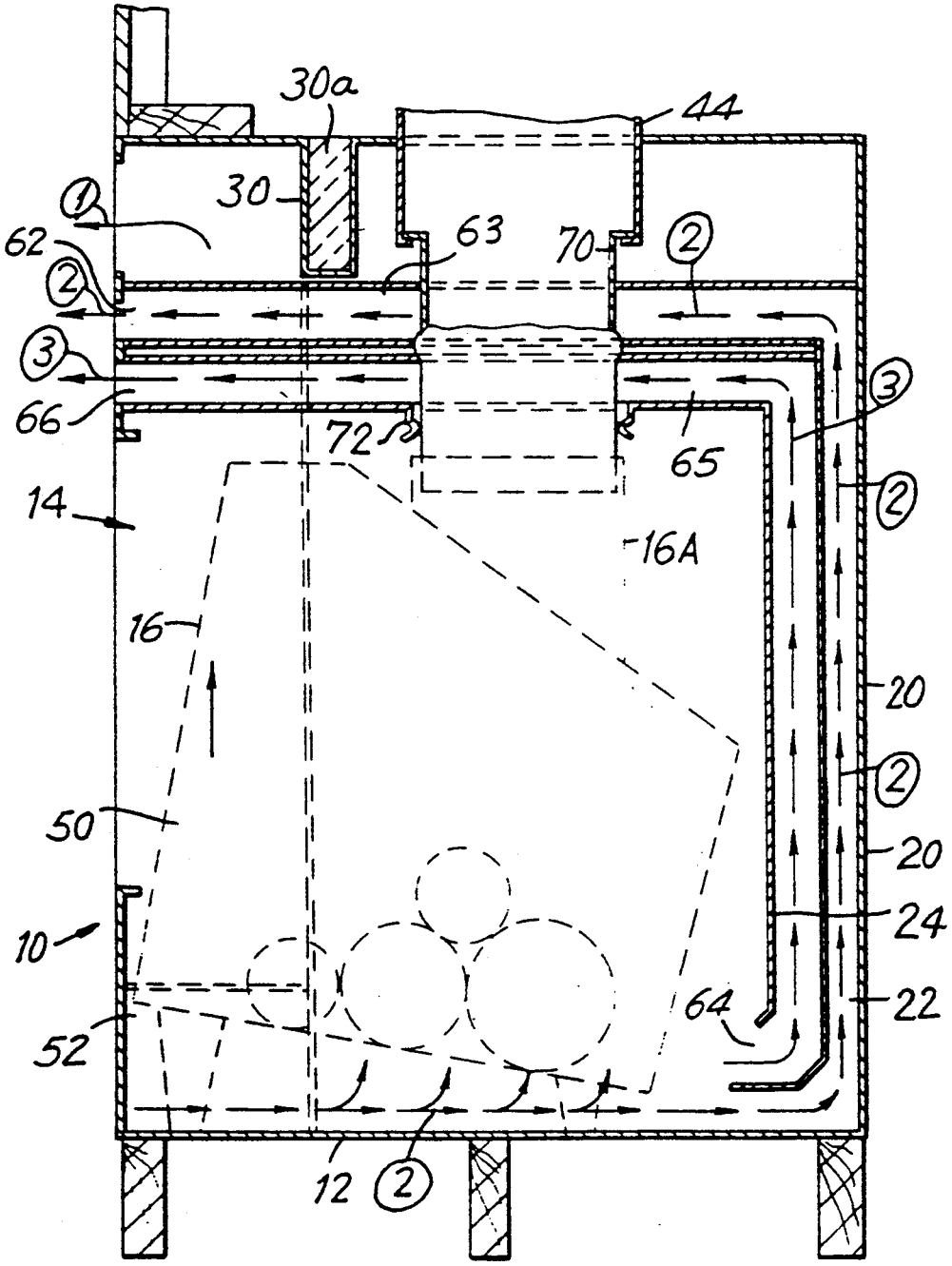
FIG. 4 shows a left side cross-sectional view of the unit according to FIG. 1, also showing airflow therein, and illustrating the manner in which a fireplace insert can be disposed therein.

As illustrated in the drawings, the WSCS unit 10 comprises a generally rectangular box having an outer shell 12. The outer shell 12 defines a front opening 14 through which a combustion unit, such as the wood kiln shown in Applicant's U.S. Pat. No. 4,681,087, can be inserted as shown in dotted line at 16 in FIG. 4. As indicated in FIG. 4, the combustion unit 16 comprises a chimney portion 16A which communicates with the chimney 44 of the unit 10 according to the invention for carrying wood smoke therefrom into a prefabricated metal chimney installed in the home.

According to the invention, substantial quantities of air are caused by convection to flow entirely around the inner surface of the unit 10. This allows flammable building materials to be closely juxtaposed to the unit 10. In particular, flammable materials can be juxtaposed flush to the edges of the front of the unit as indicated in FIG. 4. Three separate airflow paths are indicated by the circled reference numerals 1–3.

Figure 1:
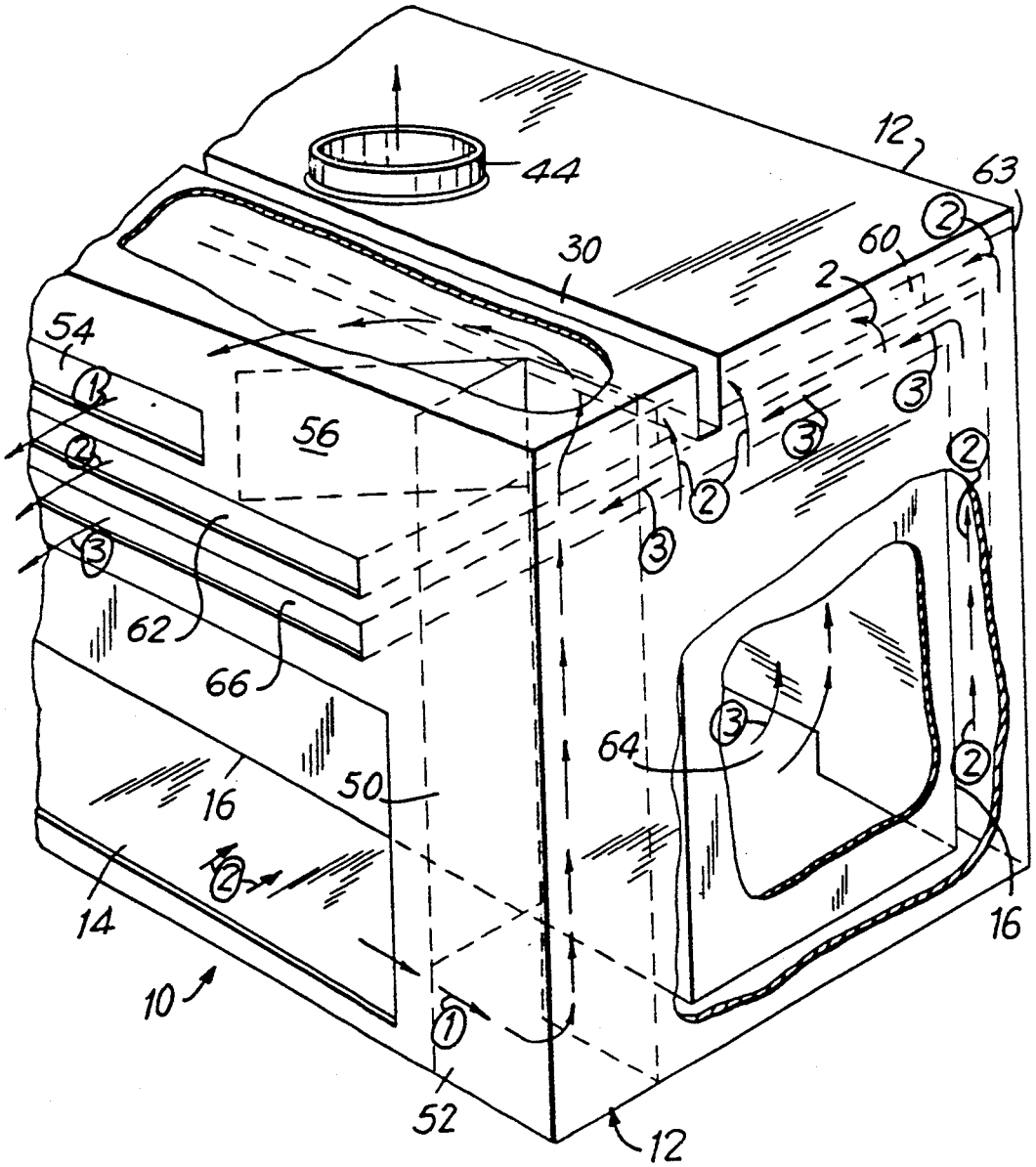
FIG. 1 shows a partially cut-away perspective view of the right half of a WSCS unit according to the invention, with arrows illustrating airflow therein.

As shown in FIG. 1, the top of the WSCS unit has formed integrally therein a U-shaped channel 30, which serves to support a chimney and also serves as a thermal break. The channel 30 and the remainder of the outer surface of the unit are made of sheet metal. 20 gauge mild steel or lighter may be used for the outer box and structural members such as the U-beam 30. 26 gauge mild steel may be used for internal ducting and other non-structural members. Chimney members which are in direct contact with wood smoke from the fire may be formed of stainless steel.

A first airflow path 1 extends through vertical ducts 50 disposed on either side of the front fuel-receiving opening 14. Openings 52 provide entry of cooling air in ducts 50 on either side of the bottom of the fuel-receiving opening 14 in the front of the unit 10. The airflow path 1 extends upwardly as indicated by the arrows and then at the top of the box turns inwardly towards the center front of the box, and exits through an opening 54 formed therein. Internal baffles 56 are provided as shown in FIGS. 1 and 2 to ensure that the airflow 1 closely approaches the center of the top of the unit, which is typically the hottest part of a fireplace, to ensure that this area is adequately cooled.

As indicated, a transverse U-shaped member 30 is formed in the top of the unit 10. Member 30 provides substantial strength to the unit so that it can support a chimney. Member 30 also forms the rear of ducts 50 through which airflow path 1 extends. Furthermore, according to the invention, U-shaped member 30 provides a thermal break between the area around the top of the unit at which the chimney 44 exits the unit 10, which is normally quite hot, and the front surface of unit 10, which is in contact with flammable building materials. The U-shaped member 30 may have insulation placed therein as indicated at 30*a*.

Thus, according to an important aspect of the invention, U-shaped member 30 provides several distinct functions in a highly efficient fashion. It is a thermal break, which insulates the chimney 44 from the front of the top of the unit 10, such that flammable building materials can be juxtaposed thereto. As also noted, the thermal break 30 is U-shaped and is formed of relatively heavy sheet metal; this provides sufficient beam strength that the WSCS unit 10 according to the invention can support the weight of a metal chimney thereon. This fact is of substantial importance, in that it simplifies the construction of a house constructed employing the inventive WSCS unit, because no additional support need then be provided for the chimney, and, as such, the combustion unit may be readily removed from the WSCS unit.

Airflow paths 2 and 3 are also shown in the drawings, and cool the sides, bottom and rear wall of the unit. Airflow paths 2 and 3 are defined by internal duct members. In effect, airflow path 2 extends between the walls of the shell 12 and side, back and top walls of an inner shell, while airflow path 3 extends between this inner shell and third innermost rear and top wall members.

More specifically, and as indicated in FIG. 4, airflow path 2 extends along the bottom of the unit, beneath the combustion unit 16, upwardly along the side walls of the unit, back to the rear corners as indicated in FIGS. 1, 3 and 4, and also up along the outer back wall of the unit 12. Airflowing along path 2 up the side walls enters a duct 63, which fits just under the thermal break 30 as illustrated in FIG. 4, through openings 60 which extend laterally outwardly, that is, towards the right and left sides of the unit. Airflow path 2 exits duct 63 through an opening 62 in the front of the unit 10. Airflow path 2 thus cools the bottom, sides, and rear of the unit.

The third airflow path 3 begins in an opening 64 in the bottom rear of the unit, as indicated in FIGS. 1 and 4, and extends upwardly along the rear of the unit as indicated in FIG. 4, between an innermost rear wall 24 and a central rear wall 22 separating airflow paths 2 and 3. Air flow path 3 then enters a duct 65 beneath duct 63, and exits the front of the unit at an opening 66 as indicated in FIGS. 1 and 4. As can be seen from FIG. 2, the ducts 63 and 65, by which airflow paths 2 and 3 extend from the rear top of the unit to their exits at openings 62, 66, respectively, each pass around the chimney 44 where it passes through the top of the unit 10, thus further cooling this critical area.

The combustion unit 16 is made removable from the unit 10 for cleaning and maintenance purposes. Preferably, a section of the chimney duct member 44 indicated schematically at 70 is a slip fit over the chimney portion 16A of the combustion unit such that it can be slid upwardly to allow ready removal of the combustion unit 16. Clips 72 illustrated in FIG. 4 may be provided to hold the slip fit section 70 in place during such operations.

As indicated schematically in FIG. 4, the WSCS unit 10 according to the invention may be directly juxtaposed to wood and other flammable materials due to the unique nature of its construction which provides a flow of insulative air all the way around its inner surface.

Figure 5:
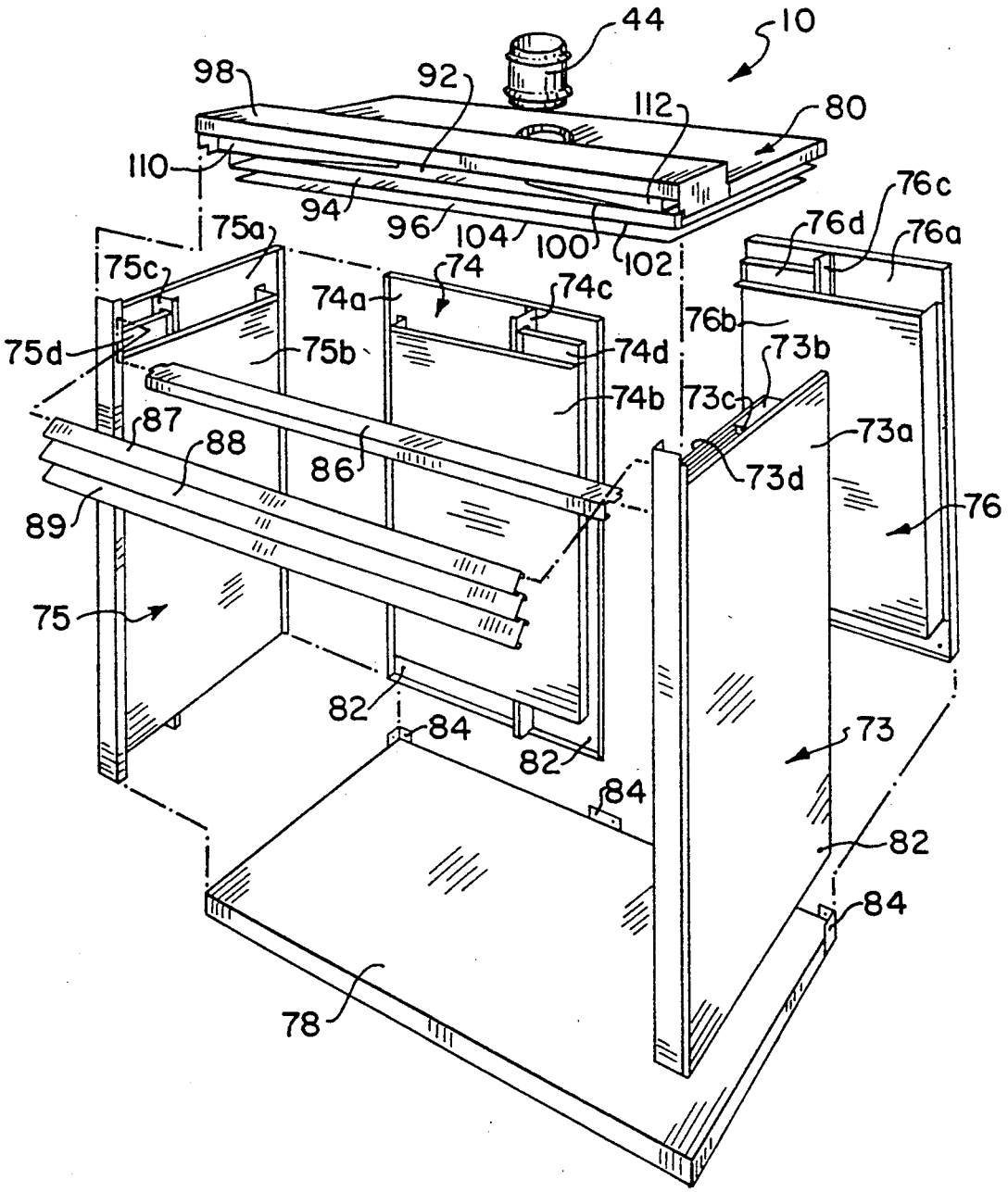
FIG. 5 shows an exploded perspective view of a modular WSCS unit according to a preferred embodiment of the present invention.
Figure 6:
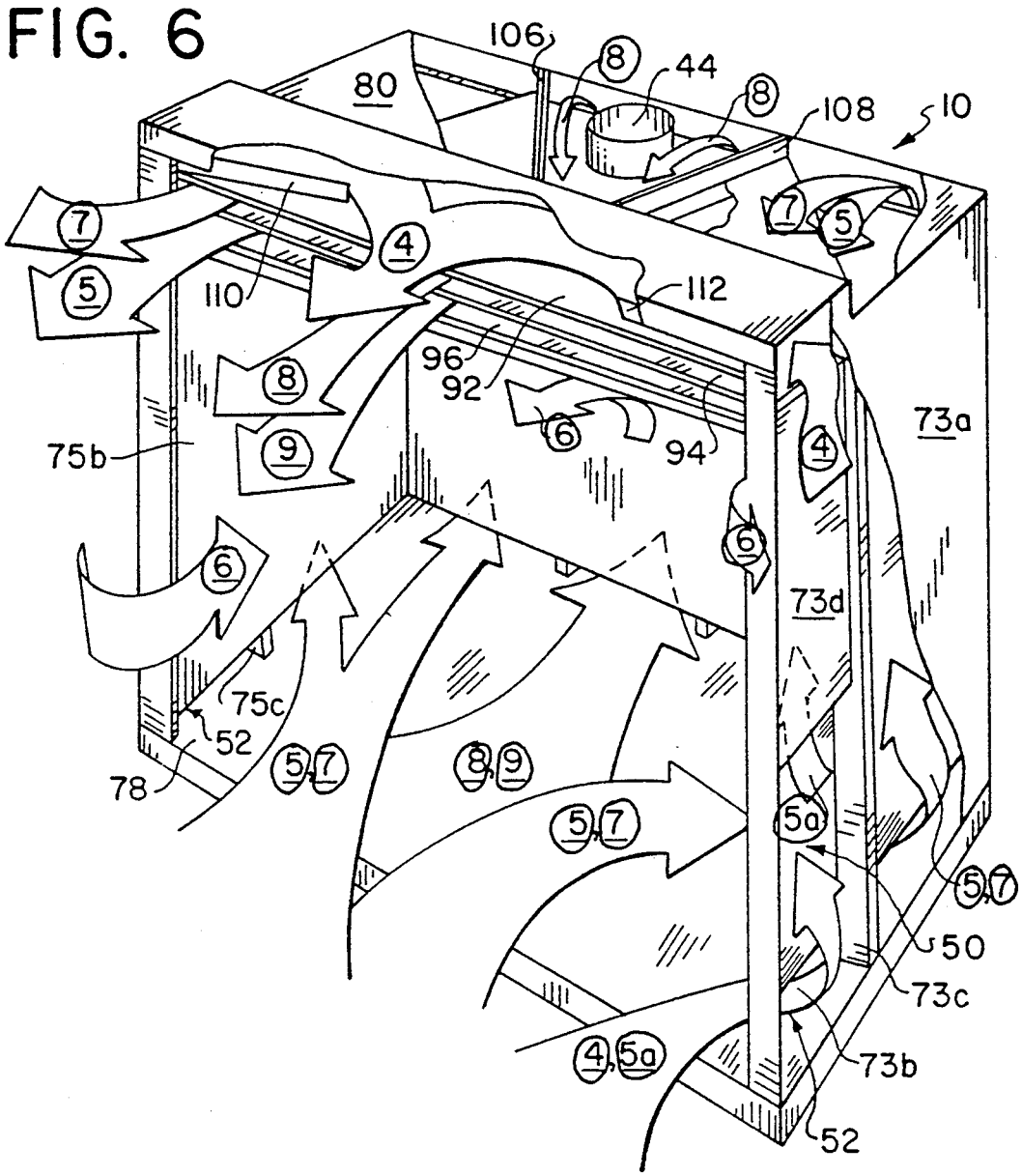
FIG. 6 shows a partially cut-away perspective view of the assembled WSCS unit FIG. 5 with arrows illustrating airflow therein.
Figure 7:
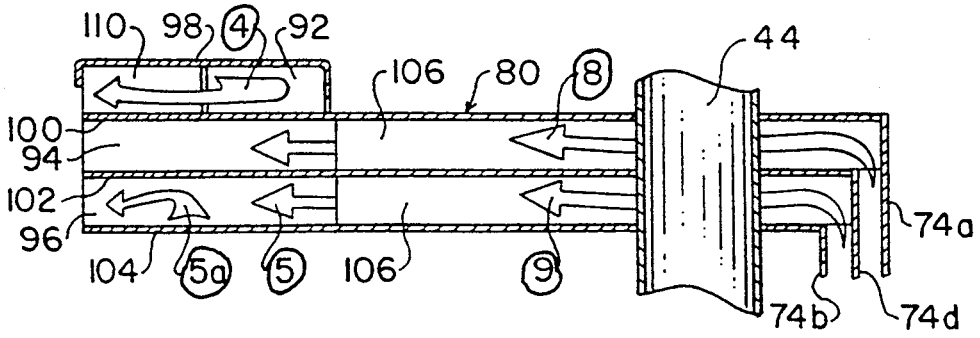
FIG. 7 shows a left side cross-sectional view of the heat exchanger according to a preferred embodiment of the present invention.

Referring now to FIGS. 5, 6 and 7, a preferred embodiment of the wall shield and chimney support (WSCS) is again shown generally at 10. The WSCS again comprises a generally rectangular box having an outer shell 12. The unit 10 preferably constructed as a modular assembly which may be disassembled to facilitate packaging and shipping. Thus in the preferred embodiment, the unit 10 is constructed by assembling side panels 73, 75, rear panels 74, 76, base 78 and upper heat exchanger 80 together just prior to installation. Chimney duct member 44 in heat exchanger 80 communicates between the residential chimney and the interior of the WSCS into which a combustion unit such as previously described is placed. In order to further strengthen the assembly and provide an aesthetically pleasing appearance, transverse bar 86 is provided. Also, vanes 87, 88, 89 further improve the outer appearance and direct airflow from heat exchanger 80. The assembled unit 10 may be welded or held together by fasteners such as screws passing through holes 82 and into brackets 84, although many other ways of fastening are possible. Of course, a one piece non-modular WSCS may also be constructed in accordance with the present invention.

As shown in FIG. 6, a first airflow 6 is simply the normal flow of air around the combustion unit placed in the cavity of unit 10. Four other airflows 5, 7, 8 and 9 are created from air drawn over the surface of base 78 and up into side panels 73, 75 and rear panels 74, 76 through air inlets 52*a–d*. As can best be seen in FIG. 5, panels 73–76 have at least a double walled portion defined by outer walls 73*a–*76*a*, and inner walls 73*b–*76*b* respectively. Outer walls 73*a–*76*a*, along with base 78 and heat exchanger 80 also define the outer shell 12. The inner walls 73*b–*76*b*, unlike the outer provide air inlets 52*a–d*through which air may be drawn from the base 78 into the interiors of panels 73–76. As shown in FIG. 6, inlets 52*a* are formed by the gap between side panel inner walls 73*b*, 75*b* and base 78. Ducts 50 are formed by inner walls 73*b*, 75*b* and outer walls 73*a*, 75*a* respectively. Panels 73–76 each have a triple walled portion formed by splitters 73*c–*76*c* and internal walls 73*d–*76*d*. The internal walls 73*d–*76*d* thus function as means for separating airflow within the double walled ducts 50 of panels 73–76 into two separate airflows. In order to save weight and material, internal walls 73*d–*76*d* extend only about half way down the unit 10. Splitters 73*c–*76*c* also serve to reinforce the side and rear panels so that a chimney may rest on WSCS 10 without need for other structural support.

As can be seen in FIGS. 6 and 7, airflows coming out of panels 73–76 are vented out of the unit 10 by heat exchanger 80. The heat exchanger 80 has three passages 92, 94, 96 defined by walls 98, 100, 102, 104 and vertical wall 105. As can best be seen in FIGS. 5 and 7, the panel outer walls 73*a–*76*a* mate with heat exchanger wall 100, the inner walls 73*b–*76*b* with wall 104 and the internal walls 73*d–*76*d* with wall 102. Air ducted between the walls comprising the panels 73–76 will thus flow into one of the heat exchanger passages 92, 94, 96 depending on how the panel walls are mated to the heat exchanger walls. For example, passage 94 is only open to airflows passing between side panel internal walls 73*d*, 75*d* and outside walls 73*a*, 75*a*. Furthermore, as shown in FIGS. 6 and 7, converging baffles 106 and 108 focus the air flowing into passage 94 from between rear panel outside walls 74*a*, 76*a* and internal walls 74*d*, 76*d* around and onto chimney duct 44. The baffles 106 and 108 likewise focus the airflowing into passage 96 from between inner walls 74*b*, 76*b* and internal walls 74*d*, 76*d*, around and onto the chimney duct 44. Baffles 106 and 108 also constitute metal beams running from the top of the rear wall stiffeners 74*c* and 76*c* to the vertical wall 105 of the heat exchanger 80. Vertical wall 105 also forms a beam resting on side stiffiners 73*c* and 75*c* which further reinforces the WSCS 10 in order to support a prefabricated metal chimney installed in the home. Thus, the function of vertical wall 105 is similar to that of U-shaped channel 30 shown in the embodiment of FIG. 4.

The airflow paths are shown in FIG. 6 where airflows 5, 7 are drawn together from base 78, through the double walled portions of panels 73–76 and into heat exchanger passages 94, 96. Two separate side airflows 4, 5*a* are drawn into the triple walled portions of side panels 73, 75 and divided by internal wall 73*d*, 75*d* so that airflow 5*a* passes between the combustion chamber and airflow 4, thereby acting as an insulator. Airflow 4 is thus relatively cool upon entering heat exchanger passage 92. To provide maximum cooling, the airflow 4 is guided to the hottest area at the rear of passage 92 by baffles 110, 112 before venting out of passage 92 at the front of the heat exchanger.

Two separate rear airflows 8, 9 are drawn into the triple walled portion of rear panels 74, 76 with flow 8 entering heat exchanger passage 94 and flow 9 entering passage 96. The baffles 106 and 108 focus the airflows 8 and 9 on the hot areas surrounding chimney duct member 44 thus greatly decreasing the chimney temperature. After passing between baffles 106, 108, the airflows 8 and 9 mix with airflows 7 and 5 respectively and are thus cooled before exiting passages 94 and 96 at the front of heat exchanger 80. Airflow 5*a* also mixes with airflow 5 in passage 96 of the heat exchanger 80.

The preferred embodiment thus has several advantages in that cooling around the chimney area 44 is greatly improved by focusing the airflows 8 and 9 on the chimney and also in that airflow 4 is kept cool through the insulating action of airflow 5*a*. A hot combustion unit may thus be placed adjacent to the front of side panels 73, 75 and heat exchanger 80 and remain thermally isolated from combustion heat due to the increased cooling action of airflow 4.

As can be seen, no house air is exhausted up the chimney in cooling the WSCS. The airflows are so effective in returning heat to the room that no blowers are needed and the WSCS efficiency approaches that of a free standing stove with a pipe through the ceiling.

While a preferred embodiment of the invention has been disclosed, the invention is not to be limited thereby, but only by the following claims.

What is claimed is:

1. A wall shield and chimney support (WSCS) unit for insertion into a wall of a dwelling and for receiving a combustion unit, said WSCS unit comprising:

a box having a rear wall, two side walls, a top wall and a bottom wall, said rear, side, top and bottom walls defining a front opening to the interior of said box;

a chimney duct member extending through the top wall and adapted to mate with an associated chimney in the dwelling;

air inlets defined by the bottom, side and rear walls;

side ducting means defined by the side walls for ducting airflow from the air inlets near the bottom wall up along the side walls to the top wall, said side ducting means including side airflow separating means for providing two separate airflows from inlets near the bottom wall up the front lateral corners of the box, one of said two separate side airflows being interposed between the box interior and the other of said two separate side airflows, and venting means associated with the top wall for venting said airflows from the front of the unit.

2. The WSCS unit of claim 1 wherein said side ducting means are formed by double wall construction of the side walls and said side airflow separating means are formed by triple wall construction of the side walls adjacent the front lateral corners of the box, said triple wall construction having an internal wall extending only about half way down the side wall from the top wall.

3. The WSCS unit of claim 1 further including rear ducting means defined by the rear wall for ducting airflow from the air inlets near the bottom wall, up along the rear wall to the top wall, said rear ducting means including rear airflow separating means for providing two separate rear airflows from the inlets near the bottom center of the rear wall, one of said two separate rear airflows being interposed between the box interior and the other of said another two separate rear airflows.

4. The WSCS unit of claim 3 wherein said venting means comprises means for directing said two separate rear airflows around and onto said chimney duct member.

5. The WSCS unit of claim 4 wherein said venting means further comprises means for mixing selected airflows with said two separate rear airflows after they have been directed around and onto the chimney duct member prior to venting said airflows, whereby cooling of the unit is further improved, and said venting means further providing support for an associated chimney of the dwelling.

6. The WSCS unit of claim 4 wherein said directing means comprise beams disposed within said venting means, providing a narrowing passage around the chimney duct member for said two separate rear airflows.

7. The WSCS unit of claim 4 wherein said rear ducting means are formed by double wall construction of the rear wall and said rear airflow separating means are formed by triple wall construction adjacent the center of the rear wall, said triple wall construction having an internal wall extending only about half way down the rear wall from the top wall.

8. The WSCS unit of claim 1 wherein said rear wall, side walls, bottom wall and top wall are modular panels constructed with double and triple walls, said panels capable of being disassembled and assembled to facilitate packaging and shipping of the unit.

9. The WSCS unit of claim 1 including in combination a combustion unit within the interior of said box and accessible through the front opening with said chimney duct member communicating with chimney means associated with the combination unit, and wherein said airflows enter the front opening and flow under the combustion unit to the air inlets.

10. A wall shield and chimney support (WSCS) unit for insertion into a wall of a dwelling and for receiving a combustion unit, said WSCS unit comprising:

a box having a rear wall, two side walls, a top wall and a bottom wall, said rear, sides, top and bottom walls defining a front opening to the interior of said box;

a chimney duct member extending through the top wall and adapted to mate with an associated chimney in the dwelling;

air inlets defined by the bottom, side and rear walls;

rear ducting means defined by the rear wall for ducting airflow from the air inlets near the bottom wall up along the rear wall to the top wall, said rear ducting means including rear airflow separating means for providing two separate rear airflows from the air inlets near the bottom center of the rear wall, one of said two separate airflows being interposed between the box interior and the other of said two separate rear airflows, and venting means associated with the top wall for venting said airflows from the front of the unit, said venting means including means for directing said two separate rear airflows around and onto said chimney duct member, said directing means providing a narrowing passage around said duct member.

11. The WSCS unit of claim 10 wherein said rear ducting means are formed by double wall construction of said rear wall and said rear airflow separating means are formed by triple wall construction adjacent the center of the rear wall, said triple wall construction having an internal wall extending only about half way down the rear wall from the top wall.

12. The WSCS unit of claim 10 further including side ducting means defined by the side walls for ducting airflow from the air inlets near the bottom wall up along the side walls to the top wall, said side ducting means including side airflow separating means for providing two separate side airflows from the air inlets near the bottom wall up the front lateral corners of the box, one of said two separate side airflows being interposed between the box interior and the other of said another two separate side airflows.

13. The WSCS unit of claim 12 wherein said side ducting means are formed by double wall construction of the side walls and said side airflow separating means are formed by triple wall construction of the side walls adjacent the front lateral corners of the box, said triple wall construction having an internal wall extending only about half way down the side wall from the top wall.

14. The WSCS unit of claim 10 wherein said venting means further comprises means for mixing airflow from said rear ducting and said side ducting means including the first of said two separate side airflows with the first of said two separate rear airflows, and for mixing airflow from said rear ducting means and said side ducting means with the second of said two separate rear airflows, while maintaining the second of said two separate side airflows separated from other airflows, said mixing occurring after said two separate rear airflows are directed around the chimney duct and prior to venting from the unit, and said venting means further providing support for an associated chimney in the dwelling.

15. The WSCS unit of claim 10 wherein said rear wall, side walls, bottom wall and top wall are modular panels, constructed with double and triple walls, said panels capable of being disassembled and assembled to facilitate packaging and shipping of the unit.

16. The WSCS unit of claim 10 including in combination a combustion unit within the interior of said box and accessible through the front opening with said chimney duct member communicating with chimney means associated with the combination unit, and wherein said airflows enter the front opening and flow under the combustion unit to the air inlets.

17. A wall shield and chimney support (WSCS) unit for insertion into a wall of a dwelling and for receiving a combustion unit, said WSCS unit comprising:

a box having a rear wall, two side walls, a top wall and a bottom wall, said rear, side, top and bottom walls defining a front opening to the interior of said box;

a chimney duct member extending through the top wall and adapted to mate with an associated chimney in the dwelling;

air inlets defined by the bottom, side and rear walls;

side ducting means defined by the side walls for ducting airflow from the air inlets near the bottom wall up along the side walls to the top wall, said side ducting means including side airflow separating means for providing two separate side airflows from the air inlets near the bottom wall, up the front lateral corners of the box, a first of said two separate side airflows being interposed between the box interior and the second of said two separate side airflows;

rear ducting means defined by the rear wall for ducting airflow from the air inlets near the bottom wall up along the rear wall to the top wall, said rear ducting means including rear airflow separating means for providing two separate rear airflows from the air inlets near the bottom center of the rear wall, a first of said two separate rear airflows being interposed between the box interior and the second of said two separate rear airflows;

venting means defined by the top wall for venting said airflows from the front of the unit and supporting the chimney, said venting means comprising means for directing said two separate rear airflows around and onto the chimney duct member, said directing means providing a narrowing passage around the chimney duct member, said directing means further providing front to back stiffening of the top wall, means for mixing airflow from said rear ducting means and said side ducting means including the first of said two separate side airflows with the first of said two separate rear airflows, and means for mixing airflow from said rear ducting means and said side ducting means with the second of said two separate rear airflows, said mixing occurring after said two separate rear airflows are directed around the chimney duct and prior to venting from the unit, and a transverse duct member extending across the top front of the box, communicating with the side airflow separating means and receiving only the second of said two separate side airflows, with said airflows being directed to cool the top wall adjacent the chimney duct member, said transverse duct member being disposed above the mixing means and having a vertical wall for side to side stiffening of the top wall and supporting the chimney.

18. A wall shield and chimney support unit for insertion into a wall of a dwelling, said unit comprising:

a box having a base supporting a vertical rear panel, a vertical left side panel, a vertical right side panel, said panels supporting a top member, said box defining an interior cavity with a front opening; and a chimney member extending through the top member and adapted to mate with an associated chimney of the dwelling; wherein said side panels have a double wall construction defining air inlets (52*a*, 52*b*) along the base and a first airflow path (5, 7) up through the panel, said side panels further having a triple wall construction adjacent the front lateral corners of the box defining a second airflow path (4) spaced from the interior of the box by a third airflow path (5*a*);

said rear panel has a double wall the base and a fourth airflow path (5, 7) up through the panel, said rear panel further having a triple wall construction of limited width up the center of the rear panel, said triple wall construction defining a fifth airflow path (8) spaced from the box interior by a sixth airflow path (9); and said top member has a triple wall construction with beam members (106, 108) defining two narrowing passages around said chimney duct member, one each communicating with said fifth (8) and sixth (9) paths forming a continuation of said fifth and sixth paths, said triple wall construction further defining a seventh airflow path (7) above an eighth airflow path (5), both communicating generally with said first and fourth paths (5, 7), said top member further having a quadruple wall construction portion extending along the front of the unit defining ninth (92), tenth (94) and eleventh (96) airflow paths, said ninth path (92) communicating only with said second path (4), said tenth path (94) communicating with said seventh (7) and fifth (8) paths and said eleventh path (96) communicating with said third (5*a*), sixth (9) and eighth paths (5).

* * * * *